United States Patent [19]

Nakano et al.

[11] 4,440,128

[45] Apr. 3, 1984

[54] METHOD AND APPARATUS FOR CONTROLLING THE IDLING ROTATIONAL SPEED OF AN INTERNAL COMBUSTION ENGINE

[75] Inventors: Jiro Nakano, Okazaki; Yohei Watanabe, Toyota, both of Japan

[73] Assignee: Toyota Jidosha Kogyo Kabushiki Kaisha, Toyota, Japan

[21] Appl. No.: 340,253

[22] Filed: Jan. 18, 1982

[30] Foreign Application Priority Data

Jan. 19, 1981 [JP] Japan ..... 56-5128

[51] Int. Cl.[3] ..... F02D 33/02

[52] U.S. Cl. ..... 123/339; 123/179 B; 123/361; 123/585

[58] Field of Search ..... 123/339, 179 B, 179 A, 123/179 G, 585, 361

[56] References Cited

U.S. PATENT DOCUMENTS

| | | | |
|---|---|---|---|
| 3,960,130 | 6/1976 | Peterson, Jr. | 123/179 A |
| 3,964,457 | 6/1976 | Coscia | 123/339 |
| 4,212,272 | 7/1980 | Hawk | 123/339 |
| 4,359,983 | 11/1982 | Carlson et al. | 123/339 |
| 4,364,348 | 12/1982 | Itoh et al. | 123/339 |

*Primary Examiner*—Andrew M. Dolinar

*Attorney, Agent, or Firm*—Cushman, Darby & Cushman

[57] ABSTRACT

The idle air flow is adjusted by a step motor depending upon a drive signal applied to the step motor, so as to control the idling rotational speed of the engine. When the engine is under a certain operating condition during cranking, in which condition the step motor cannot be normally actuated, the drive signal is inhibited from being applied to the step motor.

16 Claims, 5 Drawing Figures

METHOD AND APPARATUS FOR CONTROLLING THE IDLING ROTATIONAL SPEED OF AN INTERNAL COMBUSTION ENGINE

BACKGROUND OF THE INVENTION

The present invention relates to a method and an apparatus for controlling the idling speed of an internal combustion engine by controlling the intake air flow rate.

A known system for controlling the idling speed consists of controlling, by a closed-loop, the closed position of a throttle valve or the opening degree of a flow-control valve in a bypass intake passage which is provided in parallel with an intake passage that accommodates the throttle valve, by using a step motor depending upon the rotational speed of the engine during idling. In such a system, the open-loop control, not the closed-loop control, of the idling rotational speed is executed during cranking by applying a drive signal having a predetermined constant value to the step motor.

However, during cranking, since a large current flows to the starter motor, the battery voltage is greatly lowered, causing the step motor to fail to actuate or to incorrectly actuate. In other words, during cranking, there often occurs a step-out operation of the step motor. At a low atmospheric temperature, since the battery voltage is greatly lowered, the step-out operation of the step motor is more likely to occur. The above step-out operation causes a difference between the actual rotating position of the step motor and the rotating position as recognized by the control circuit. As a result, the intake air flow rate, which determines the idling rotational speed, cannot be correctly controlled either during cranking or after cranking.

SUMMARY OF THE INVENTION

It is, therefore, an object of the present invention to provide a method and an apparatus for controlling the idling rotational speed of an internal combustion engine by controlling the intake air flow rate, whereby the operation of the step motor is inhibited during cranking to prevent step motor step-out from occurring.

According to the present invention, a method for controlling the idling rotational speed of an internal combustion engine, which has a step motor for adjusting the idle air flow to the engine when a drive signal, which is determined depending upon the operating condition of the engine, is applied thereto, comprises the steps of: generating a cranking signal which indicates that the engine is cranking; generating at least one engine parameter signal which indicates the operating condition of the engine; judging, in response to the engine parameter signal and the cranking signal, whether or not the engine is under a certain operating condition, during cranking, wherein the step motor cannot be normally actuated; and when the engine is under the certain operating condition during cranking, inhibiting the drive signal from being applied to the step motor.

Furthermore, according to the present invention an apparatus for controlling the idling rotational speed of an internal combustion engine comprises: a step motor for adjusting the idle air flow to the engine when a drive signal, which is determined depending upon the operating condition of the engine, is applied thereto; generation of a cranking signal which indicates the engine is cranking; generation of at least one engine parameter signal which indicates the operating condition of the engine; and processing means, in response to the engine parameter signal and the cranking signal, for (1) judging whether or not the engine is under a certain operating condition during cranking, whereby the step motor cannot be normally actuated, and (2) inhibiting the drive signal from being applied to the step motor when the engine is under the certain operating condition during cranking.

The above and other related objects and features of the present invention will be apparent from the description of the present invention set forth below, with reference to the accompanying drawings, as well as from the appended claims.

DETAILED DESCRIPTION OF THE PREFERRED EMBODIMENTS

Figure 1:
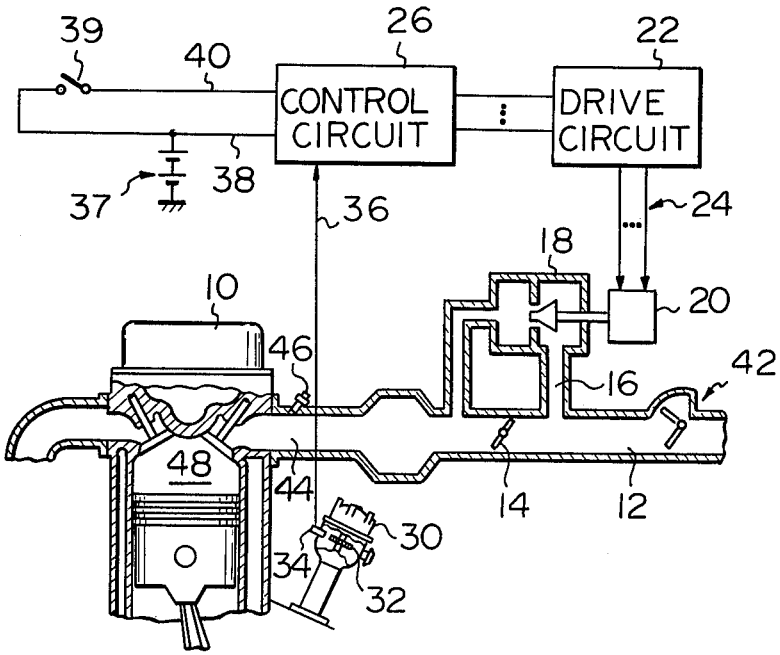
FIG. 1 is a schematic diagram illustrating an embodiment of the present invention.

FIG. 1 schematically illustrates a system for controlling the idling speed, which is applied to an electronically controlled fuel injection-type internal combustion engine according to an embodiment of the present invention. In FIG. 1, reference numeral 10 denotes an engine body, and 12 denotes an intake passage having a throttle valve 14. A control valve 18 is provided in a bypass intake passage 16 which communicates with the intake passage on the upstream side of the throttle valve 14 with the intake passage on the downstream side of the throttle valve 14, bypassing the throttle valve 14. The control valve 18 works to control the cross-sectional area of the passage 16. The opening and closing of the control valve 18 is controlled by a step motor 20. The step motor 20 is energized by electric current of plural phase which is supplied from a drive circuit 22 via lines 24. The drive circuit 22 is provided with drive signals by a control circuit 26.

A distributor 30 of the engine is provided with a rotary plate 32 attached to the distributor shaft and a crank angle sensor 34 which detects the passing of the projections on the rotray plate 32. The projections are formed at predetermined angular intervals along the peripheral of the plate 32 and generates crank angle signals. Therefore, the crank angle signal is produced each time the engine rotates by a predetermined crank angle. The crank angle signal is fed to the control circuit 26 via a line 36.

A voltage signal, which indicates the power supply voltage across a battery 37, and a starter signal, which indicates the starter motor is being driven, are fed to the control circuit 26 via lines 38 and 40, respectively.

As is well known, in electronic control fuel injection internal combustion engines of this type, the flow rate of the intake air sucked into the engine is detected by an air-flow sensor 42 disposed in the intake passage 12, and fuel is supplied in an amount in accordance with the detected flow rate of the intake air into a combustion chamber 48 of the engine from a fuel injection valve 46 mounted in an intake manifold portion 44. Therefore, the rotational speed of the engine can be controlled by controlling the flow rate of intake air by the throttle valve 14 or the control valve 18.

Figure 2:
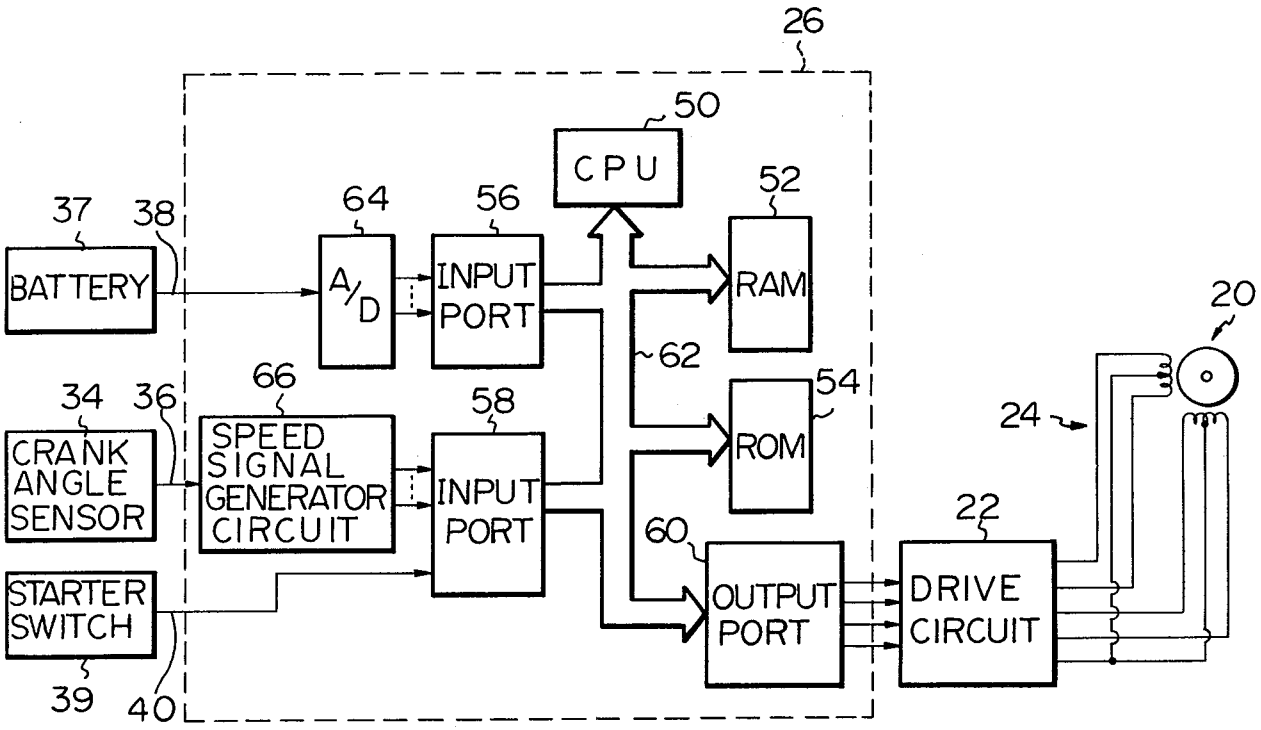
FIG. 2 is a block diagram illustrating a control circuit in FIG. 1.

FIG. 2 is a block diagram illustrating an example of the control circuit 26 of FIG. 1. A digital computer which can execute a stored program is used in the control circuit 26. The digital computer consists of a central processing unit (CPU) 50 which executes a variety of calculations, a random access memory (RAM) 52 which is capable of writing and reading data, a read-only memory (ROM) 54 in which control programs, calculation constants and various tables used for the calculations have been stored beforehand, input ports 56 and 58, and an output port 60. CPU 50, RAM 52, ROM 54, input ports 56 and 58 and output port 60 are connected to each other via a bus 62.

The input port 56 receives from an A/D converter 64 a binary signal which represents the power supply voltage appearing across the battery 37. The input port 58 receives from a speed signal generator circuit 66 a binary rotational-speed signal which represents the rotational speed of the engine. The speed signal generator circuit 66 is made up of a conventional circuit for measuring, relying upon a counter or the like, the time interval between the crank angle signal from the crank angle sensor 34. The input port 58 further receives from the starter switch 39 the starter signal of level "1" or "0", representing whether or not the starter motor is being driven, to crank the engine.

The drive circuit 22 for driving the step motor 20 is connected to the output port 60. An electric current for exciting the step motor 20 is produced by the drive circuit 22 in response to a drive signal of four bits fed from the CPU 50 via the bus 62 and the output port 60.

The operation of the embodiment will be illustrated below with reference to the flow chart shown in FIG. 3, which schematically represents the flow of a processing program stored in the ROM 54, for controlling the intake air flow rate and, therefore, the idling speed, during cranking by an open-loop control.

Figure 3:
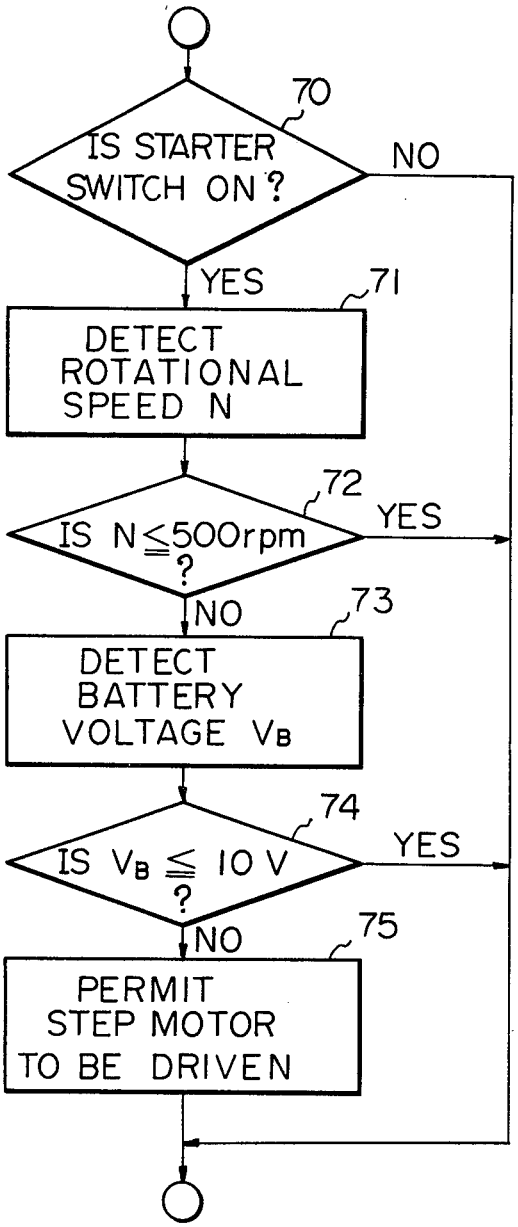
FIG. 3 is a flow chart illustrating a control program of the embodiment of FIG. 1.

After the CPU 50 is energized, the processing routine of FIG. 3 is executed during the initial processing. First, at a point 70, the CPU 50 judges whether the starter signal from the starter switch 39 is "1" or not. If the starter signal is "1", indicating that the starter motor is driven and is cranking, the program proceeds to a point 71. If the starter signal is "0", the program jumps to the main processing routine, which is not shown. At the point 71, the CPU 50 reads the rotational speed signal indicative of the present rotational speed N of the engine from the speed signal generator circuit 66. Then, at a point 72, the CPU 50 judges whether or not the present speed N is lower than, or equal to, a predetermined speed, for example, 500 rpm. If $N > 500$ rpm, the program proceeds to a point 73. If $N \leqq 500$ rpm, the program jumps to the main processing routine. At the point 73, the CPU 50 introduces voltage signal indicative of the battery voltage $V_B$. Then, at a point 74, the CPU 50 judges whether or not the battery voltage $V_B$ is lower than, or equal to, a predetermined voltage, such as 10 V. If $V_B \leqq 10$ V, the program jumps to the main processing routine. If $V_B > 10$ V, the program proceeds to a point 75 where the step motor 20 is permitted to be driven. Therefore, according to the processing routine of FIG. 3, only when both the rotational speed exceeds 500 rpm and the battery voltage exceeds 10 V during cranking is the step motor 20 driven.

If the step motor 20 is permitted to be driven at the point 75, the step motor 20, which was certainly returned to a predetermined initial position before cranking, is driven the number of steps necessary for moving from the initial position to an optimum position for cranking. The embodiment of FIG. 2 is not provided with a non-volatile back-up RAM, which maintains the stored contents even after the ignition switch is turned off. However, in the system having such a back-up RAM, the step motor 20 will not be returned to the initial position, but the final position of the step motor 20 from the last operation of the engine will be stored in the back-up RAM. Then, during the next cranking operation, the step motor 20 will be driven the number of steps required to move the step motor from the final position to an optimum position for cranking.

If the step motor 20 is of the four-pole two-phase excitation type, the drive signal will take the form of any one of "1100", "0110", "0011" or "1001". If it is presumed that a drive signal corresponding to the present position of the step motor 20 takes the form "0110", the drive signal of, for example "1100" should be produced to the output port 60. The drive circuit 22 then generates an exciting current to the pole corresponding to "1" of the drive signal; thus, the step motor 20 is turned by one step in a given direction. When the drive signal changes in sequence, the step motor 20 is correspondingly turned, and, thus, the drive signal is capable of turning the step motor 20 by a desired number of steps in a desired direction.

Figure 4:
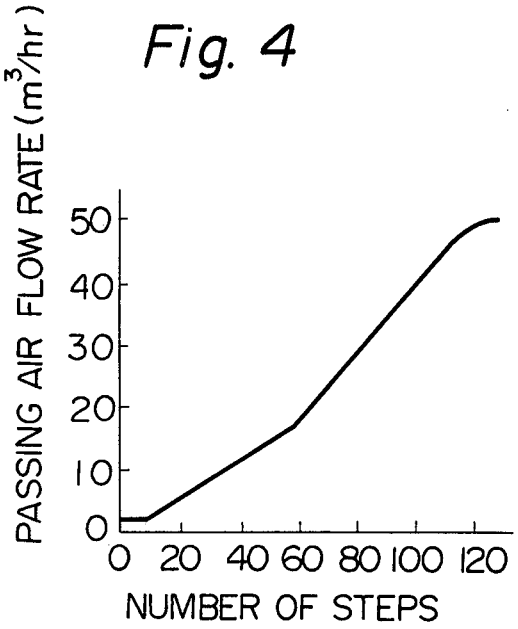
FIG. 4 is a graph illustrating the relationship between the passing air flow rate and the number of steps of the step motor.

There is a predetermined relationship between the number of steps the step motor 20 has moved from the predetermined initial position and the flow rate of air passing through the control valve 18, as shown in FIG. 4. Therefore, the intake air flow rate during idling can be accurately controlled by controlling the number of steps the step motor 20 moves from the predetermined initial position.

As will be apparent from the above description, according to the present embodiment, the step motor 20 is driven during cranking only when both the rotational speed exceeds 500 rpm and the battery voltage exceeds 10 V. Step-out of the step motor is prevented from occurring, and, therefore CPU 50 can always and correctly recognize the actual moved position of the step motor. As a result, the idling rotational speed can be accurately controlled both during cranking and after cranking.

In the processing routine of FIG. 3, either the processing of the points 71 and 72 or the processing of the points 73 and 74 are omitted in other embodiments of the present invention. Thus, step-out of step motor 20 can be prevented during cranking by driving the step motor 20 either when the rotational speed exceeds 500 rpm, or when the battery voltage exceeds 10 V.

In accordance with the present invention, the opening degree of the flow-control valve in the bypass intake passage is adjusted to control the flow rate of the intake air when the engine is in an idling condition. The present invention, however, can also be applied to an engine which does not have the bypass intake passage and in which the closing position of the throttle valve controls the flow rate of the intake air when the engine is in the idling condition.

Figure 5:
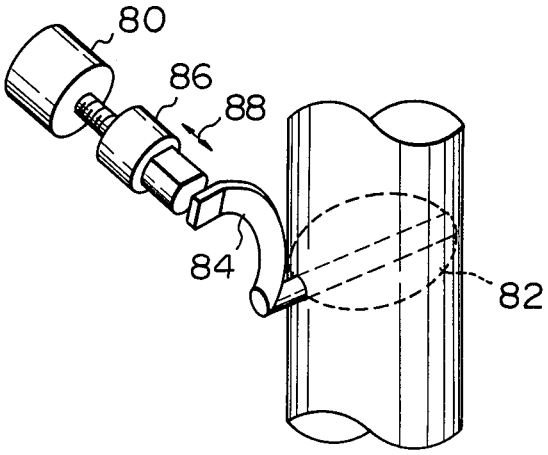
FIG. 5 is a perspective diagram illustrating another embodiment of the idle air flow adjusting mechanism of the present invention.

FIG. 5 illustrates a set-up for mechanically coupling the step motor 80 to the throttle valve 82 when the present invention is applied to engines for which idle speed is controlled by throttle valve closing position. Referring to FIG. 5, the tip of an arm 84, attached to the rotary shaft of the throttle valve 82, pushes the end surface of a linear actuator member 86. The end surface of the linear actuator member 86 serves as a stopper. As the step motor 80 rotates, the linear actuator member 86 moves in the directions of the arrow 88. Therefore, the closing position of the throttle valve 82, i.e., the opening degree of the throttle valve when the engine is in the idling condition, is controlled responsive to the rotating amount of the step motor 80. The rotating amount of the step motor 80 can be easily converted into the movement of the linear actuator member 86 in the axial direction by, for example, forming a worm screw on the rotary shaft of the step motor 80, and inserting the portion of worm screw into a threaded hole formed in the linear actuator member 86. This mechanism can also be adapted to the coupling between the control valve 18 and the step motor 20 in the embodiment of FIG. 1. The set-up, operation, functions and effects of a control unit for the step motor 80 of the embodiment of FIG. 5 are similar to those of the embodiment of FIG. 1.

As many widely different embodiments of the present invention may be constructed without departing from the spirit and scope of the present invention, it should be understood that the present invention is not limited to the specific embodiments described in this specification, except as defined in the appended claims.

We claim:

1. A method for controlling the idling rotational speed of an internal combustion engine having a step motor for adjusting the idle air flow to the engine when a drive signal, which is determined depending upon the operating condition of the engine, is applied thereto, said method comprising the steps of:

generating a cranking signal which indicates the engine is cranking;

generating at least one engine parameter signal which indicates the operating condition of the engine;

judging, in response to the engine parameter signal and the cranking signal, whether or not the engine is under a certain operating condition, during cranking, wherein the step motor cannot be normally actuated; and when the engine is under said certain operating condition during cranking, inhibiting said drive signal from being applied to the step motor.

2. A method as claimed in claim 1, wherein:

said engine parameter signal generating step includes a step of generating a speed signal which indicates the rotational speed of the engine; and said judging step includes a step of judging, in response to the speed signal and the cranking signal, whether or not the engine is under a certain operating condition where the engine is cranking and the rotational speed of the engine is equal to or lower than a predetermined speed.

3. A method as claimed in claim 1 or 2, wherein the engine has an intake passage, a throttle valve disposed in the intake passage, and a bypass passage which communicates the intake passage at a position located upstream of the throttle valve with the intake passage at a position located downstream of the throttle valve, and wherein said step motor adjusts, in response to the drive signal, the sectional area of the bypass passage.

4. A method as claimed in claim 1 or 2, wherein the engine has an intake passage, and a throttle valve disposed in the intake passage, and wherein said step motor adjusts, in response to the drive signal, the closed position of the throttle valve.

5. A method as claimed in claim 2, wherein said predetermined speed is lower than an idle rotational speed of the engine.

6. A method as claimed in claim 1, wherein:

said engine parameter signal generating step includes a step of generating a voltage signal which indicates the power supply voltage for the step motor; and said judging step includes a step of judging, in response to the voltage signal and the cranking signal, whether or not the engine is under a certain operating condition where the engine is cranking and the power supply voltage for the step motor is equal to or lower than a predetermined voltage.

7. A method as claimed in claim 1, wherein:

said engine parameter signal generating step includes the steps of generating a speed signal which indicates the rotational speed of the engine, and generating a voltage signal which indicates the power supply voltage for the step motor; and said judging step includes a step of judging, in response to the speed signal, the voltage signal and the cranking signal, whether or not the engine is under a certain operating condition where the engine is cranking, the rotational speed of the engine is equal to or lower than a predetermined speed, and the power supply voltage is equal to or lower than a predetermined voltage.

8. A method as claimed in claim 7, wherein said predetermined speed is lower than an idle rotational speed of the engine.

9. An apparatus for controlling the idling rotational speed of an internal combustion engine, comprising:

a step motor for adjusting the idle air flow to the engine when a drive signal, which is determined depending upon the operating condition of the engine, is applied thereto;

means for generating a cranking signal which indicates the engine is cranking;

means for generating at least one engine parameter signal which indicates the operating condition of the engine; and processing means, in response to the engine parameter signal and the cranking signal, for (1) judging whether or not the engine is under a certain operating condition, during cranking, where the step motor cannot be normally actuated, and (2) inhibiting said drive signal from being applied to the step motor when the engine is under the certain operating condition during cranking.

10. An apparatus as claimed in claim 9, wherein:

said engine parameter signal generating means includes a means for generating a speed signal which indicates the rotational speed of the engine; and said processing means includes a means for judging, in response to the speed signal and the cranking signal, whether or not the engine is under a certain operating condition where the engine is cranking and the rotational speed of the engine is equal to or lower than a predetermined speed.

11. An apparatus as claimed in claim 9 or 10, wherein the engine has an intake passage, a throttle valve disposed in the intake passage, and a bypass passage which communicates the intake passage at a position located upstream of the throttle valve with the intake passage at a position located downstream of the throttle valve, and wherein said step motor adjusts, in response to the drive signal, the sectional area of the bypass passage.

12. An apparatus as claimed in claim 9 or 10, wherein the engine has an intake passage, and a throttle valve disposed in the intake passage, and wherein said step motor adjusts, in response to the drive signal, the closed position of the throttle valve.

13. An apparatus as claim in claim 10, wherein said predetermined speed is lower than an idle rotational speed of the engine.

14. An apparatus as claimed in claim 9, wherein:

said engine parameter signal generating means includes a means for generating a voltage signal which indicates the power supply voltage for the step motor; and said processing means includes a means for judging, in response to the voltage signal and the cranking signal, whether or not the engine is under a certain operating condition where the engine is cranking and the voltage signal is equal to or lower than a predetermined voltage.

15. An apparatus as claimed in claim 9, wherein:

said engine parameter signal generating means includes a means for generating a speed signal which indicates the rotational speed of the engine, and a means for generating a voltage signal which indicates the power supply voltage for the step motor; and said processing means includes a means for judging, in response to the speed signal, the voltage signal and the crankingsignal, whether or not the engine is under a certain operating condition where the engine is cranking, the rotational speed of the engine is equal to or lower than a predetermined speed, and the voltage signal is equal to or lower than a predetermined voltage.

16. An apparatus as claimed in claim 15, wherein said predetermined speed is lower than an idle rotational speed of the engine.

* * * * *